United States Patent [19]

Bedell et al.

[11] 4,274,473

[45] Jun. 23, 1981

[54] CONTOUR CONTROL FOR PLANAR FLOW CASTING OF METAL RIBBON

[75] Inventors: John R. Bedell, Madison; Sheldon Kavesh, Whippany; Naim S. Hemmat, Mendham; Seymour Draizen, Old Bridge; Robert W. Smith, Long Valley, all of N.J.

[73] Assignee: Allied Chemical Corporation, Morris Township, Morris County, N.J.

[21] Appl. No.: 111,748

[22] Filed: Jan. 14, 1980

[51] Int. Cl.[3] ..... B22D 11/06

[52] U.S. Cl. ..... 164/423; 164/87

[58] Field of Search ..... 164/87, 423, 427, 429, 164/437

[56] References Cited

U.S. PATENT DOCUMENTS 4,142,571 3/1979 Narasimhan ..... 164/87 X 4,177,856 12/1979 Liebermann ..... 164/87

4,212,343 7/1980 Narasimhan ..... 164/87 X

*Primary Examiner*—Robert D. Baldwin

*Assistant Examiner*—K. Y. Lin

*Attorney, Agent, or Firm*—James Riesenfeld; Gerhard H. Fuchs

[57] ABSTRACT

An apparatus is provided for planar flow casting of metal ribbon. The apparatus comprises a movable chill surface, a reservoir for holding molten metal and a slotted nozzle whose lips are located close to the chill surface. In operation, molten metal is forced through the nozzle onto the chill surface to form a melt puddle. Rapid cooling of the molten metal results in the formation of a continuous ribbon. Ribbon contour is controlled through the use of nozzle designs that provide reproducible configuration of the melt puddle and reduce turbulent air flow over the molten metal surface.

8 Claims, 13 Drawing Figures

CONTOUR CONTROL FOR PLANAR FLOW CASTING OF METAL RIBBON

BACKGROUND OF THE INVENTION

1. Field of the Invention

This invention relates to apparatus for planar flow casting of metal ribbon, particularly ribbon of amorphous metal alloys.

2. Description of the Prior Art

For purposes of the present invention, a ribbon is a slender body of substantially rectangular cross section whose transverse dimensions are much smaller than its length.

There has long been recognized the need for processes that would permit manufacture of finished or semifinished products such as wire, ribbon or sheet directly from the molten metal. Hubert et al. provided a review of such processes and classified then available techniques into the "melt spin process" and the "melt drag process" (Zeitschrift Fuer Metallkunde 64, 835 (1973)).

In the melt spin process, a jet of molten metal is cooled, either in free flight or by jetting it against a chill block, to obtain continuous filament. Both of these embodiments employ a pressurized orifice. There is also a melt spin process operating without an orifice, wherein molten metal is supplied to a jetforming device, such as a grooved spinning disk, to be expelled therefrom. Hubert et al. stated that the key to success in the melt spin process is to stabilize the liquid jet until it solidifies. Jets of molten metal are inherently unstable and have a strong tendency for droplet formation, because molten metal generally has low viscosity and high surface tension. Basic problems of jet stability have been discussed by Butler et al. in Fiber Science and Technology 5, 243 (1972).

In the melt drag process (see U.S. Pat. Nos. 3,522,836 and 3,605,863), molten metal is made to form a meniscus held by surface tension at the outlet of a nozzle. From this meniscus, molten metal is dragged onto a rotating cooled drum or continuous belt. Although this method avoids the difficulties of jet instability inherent in the melt spin process, it suffers from another shortcoming. Melt flow at the meniscus is severely limited. This, in turn, limits the chill surface speeds that provide continuous filament. Thus, the melt drag process may not provide sufficiently high molten metal cooling rates to permit production of amorphous metal strips. Such strips require quenching of certain molten alloys at a cooling rate of at least $10^{4}$° C. per second, more usually $10^{6}$° C. per second.

U.S. Pat. No. 4,142,571, issued Mar. 6, 1979 to Narasimhan, discloses inter alia apparatus for preparing continuous metal ribbon from the melt by the planar flow casting method. The disclosure of this patent is incorporated herein by reference. It provides apparatus which comprises a movable chill body, a slotted nozzle in communication with a reservoir for holding molten metal and means for effecting expulsion of the molten metal from the reservoir through the nozzle onto the moving chill surface.

The slotted nozzle is located in close proximity to the chill surface. Its slot is oriented perpendicular to the direction of movement of the chill surface and is defined by a pair of generally parallel lips, a first lip and a second lip, numbered in the direction of movement of the chill surface. The slot has a width, measured in the direction of movement of the chill surface, of about 0.2 to 1 mm. There is no limitation on the length of the slot (measured perpendicular to the direction of movement of the chill surface) other than the practical consideration that the slot should not be longer than the width of the chill surface. The length of the slot determines the width of the strip or sheet being cast.

The first lip has a width (measured in the direction of movement of the chill surface) at least equal to the width of the slot. The second lip has a width of about 1.5 to 3 times the width of the slot. The gap between the lips and the chill surface is at least about 0.1 times the width of the slot, but may be large enough to equal the width of the slot.

As the molten metal is forced onto the chill surface, a molten puddle is formed. The puddle extends a short distance upstream, forming a meniscus extending between the chill surface and the first lip of the nozzle. It has been discovered that a unique equilibrium position for the meniscus does not exist when the first lip consists of a single plane surface parallel to the chill surface as is disclosed in the prior art. Variations in the meniscus position (i.e., distance from the slot) give rise to undesirable variations in the dimensions of the cast product.

Although casting can be done under a vacuum (see, e.g., U.S. Pat. No. 4,154,283, issued May 15, 1979, to R. Ray et al.), casting in air is more convenient. However, turbulent air movement over the surface and sides of the molten metal may cause waviness and other undesirable surface variations.

SUMMARY OF THE INVENTION

In accordance with the present invention, an apparatus for planar flow casting of metal ribbon is provided. The apparatus comprises a movable chill surface, a reservoir for holding molten metal and a nozzle in communication at its top with the reservoir and having at its bottom two lips adjacent to the chill surface, a first lip and a second lip numbered in the direction of movement of the chill surface. The lips are separated by and define a slot for depositing molten metal on the chill surface. The leading and trailing edges of the slot are substantially parallel and are generally perpendicular to the direction of movement of the chill surface. The second lip has a substantially planar bottom surface, and the first lip has a bottom surface at least part of which is not parallel to the bottom plane of the second lip. The leading edge of the first lip is separated from the chill surface by at least about 0.02 mm and is as close or closer to the chill surface than is any other point on the nozzle. No point on the bottom surface of the nozzle is more than about 1 mm from the chill surface.

Locations on the apparatus are conveniently described in relation to the direction of motion of the chill surface. Thus, as the chill surface moves, it passes first under the first lip, then the second lip; first under the leading edge, then the trailing edge; first under upstream locations, then downstream.

The chill surface of the invention may be substantially flat, such as a belt, or it may be an annular chill roll. Since the width of the bottom of the nozzle in the direction of travel of the chill surface is small compared with the radius of the chill roll, for convenience, the chill roll may be considered to approximate a plane beneath the nozzle over the width of the nozzle. When the chill surface is a belt or similar flat surface, no such approximation is necessary.

For convenience, the apparatus is described as if it were oriented vertically, with the chill surface located below the reservoir and nozzle; however, as is clear to one skilled in the art, the apparatus may also be oriented with the chill surface positioned horizontally adjacent to, or even above, the nozzle. Of course, the apparatus may also be oriented in a direction between horizontal and vertical.

DETAILED DESCRIPTION OF THE INVENTION

The apparatus of this invention permits the continuous casting of metal ribbon of controlled contour. The apparatus is an improvement over that described in U.S. Pat. No. 4,142,571, in which is disclosed the method and apparatus of planar flow casting.

Figure 1:
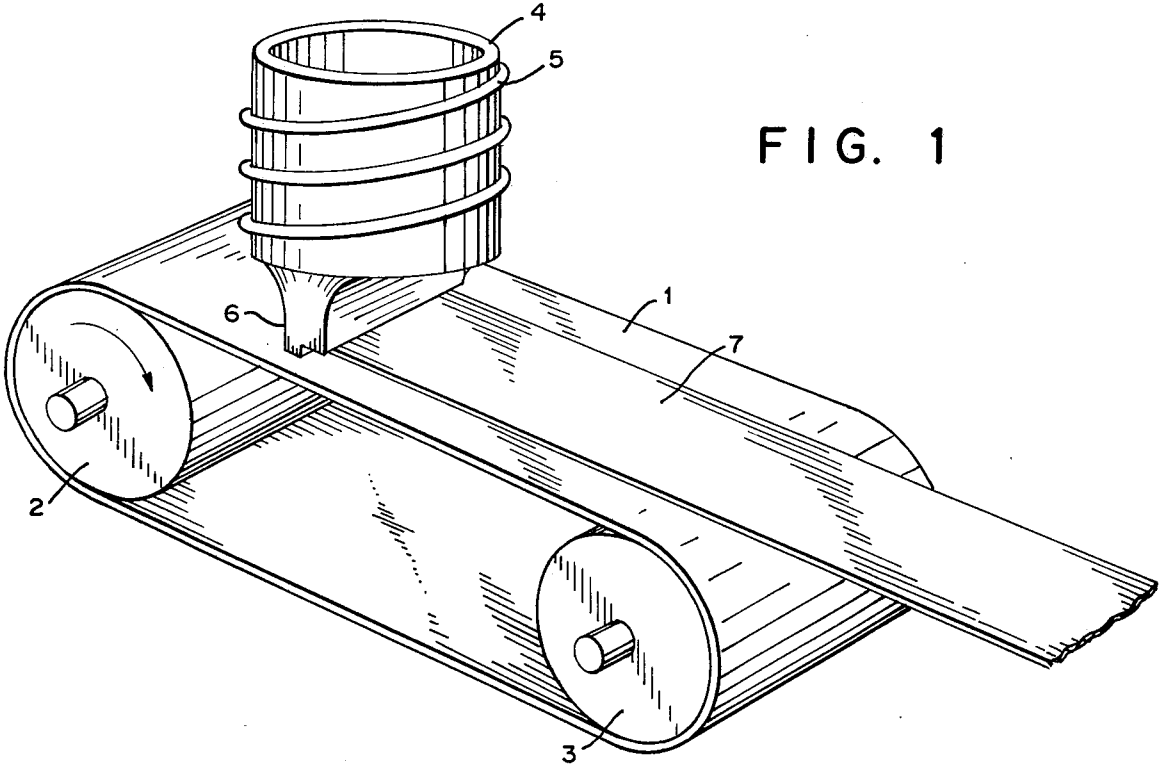
FIG. 1 is a simplified perspective view of the apparatus of this invention in an embodiment where the chill surface is an endless moving belt.

FIG. 1 shows a simplified perspective view of a planar flow casting apparatus of this invention. In the embodiment shown, the chill body is an endless belt 1 which is placed over rolls 2 and 3 which are caused to rotate by external means (not shown). Molten metal is provided from reservoir 4, equipped with means (not shown) for pressurizing the molten metal therein by gas overpressure, head pressure of molten metal or the like. Molten metal in reservoir 4 is heated by electrical induction heating coil 5. Reservoir 4 is in communication with nozzle 6 equipped with a slotted orifice. In operation, belt 1 is moved at a predetermined longitudinal velocity, ordinarily at least about 200 meters per minute. Molten metal from reservoir 4 is pressurized to force it through nozzle 6 into contact with belt 1, whereon it is solidified into a solid strip 7, which is separated from belt 1 by means not shown.

Instead of endless belt 1, the chill body may be an annular wheel rotatably mounted on its longitudinal axis. The chill surface may be of any metal having relatively high thermal conductivity, such as copper. High thermal conductivity is particularly important if it is desired to make amorphous or metastable strips. Preferred materials of construction include beryllium copper and oxygen-free copper. If desired, the chill surface may be highly polished or may be provided with a highly uniform surface, such as chrome plate, to obtain ribbon having a smooth bottom surface. To provide protection against erosion, corrosion or thermal fatigue, the surface of the chill body may be coated with a suitable resistant of high-melting coating. For example, a ceramic coating or a coating of corrosion-resistant high-melting metal may be applied by known procedures, provided that in each case the wettability of the molten metal on the chill substrate is adequate.

In short run operation, it is not ordinarily necessary to provide cooling for the chill body, provided it has relatively large mass so that it can act as a heat sink and absorb a considerable amount of heat. However, for longer runs, and especially if the chill body is a belt which has relatively little mass, cooling of the chill body is desirably provided. This may be accomplished conveniently by contacting it with cooling media which may be liquids or gases. If the chill body is a chill roll, water or other liquid cooling medium may be circulated through it or air or other gases may be blown over it. Alternatively, evaporative cooling may be employed as by externally contacting the chill body with water or other liquid medium that provides cooling through evaporation.

Crucible and nozzle materials are chosen to withstand high temperatures and thermal shock, to not react with the molten metals and to permit fabrication without undue difficulty. Suitable materials include quartz, boron nitride, aluminium oxide, graphite and other refractory materials.

The configuration of the casting nozzle is of major importance in controlling the contour of ribbon prepared by planar flow casting. In particular, the nozzle plays an important role in controlling the amount and distribution of molten metal being provided for the ribbon, containing the casting puddle, controlling the air boundary layer to prevent surface waviness and molding the metal as it hardens.

In the nozzles of the prior art, the bottom surface of the first lip is generally a plane parallel to the chill surface. This configuration does not provide a unique position for the upstream surface (meniscus) of the casting puddle. The reason is that for a given gap between lip and chill surface, there is a range of "permissible" pressures (in the molten metal) for which the meniscus will not be forced to move. This range is between a lower critical pressure and an upper critical pressure and is tabulated below for typical gaps. Thus, if the initial casting conditions cause the meniscus to locate at any point between the leading edge of the first lip and the leading edge of the slot, there is no tendency for the meniscus to move, as long as the pressure is within the permissible range for that gap. Likewise, if the meniscus is moving - due, perhaps, to factors other than pressure - there is no tendency for it to stop until it reaches one end of the first lip or the other.

TABLE

| | Critical Pressure (kPa) | |
|---|---|---|
| Gap (cm) | Lower | Upper |
| 0.0025 | 21.2 | 69.0 |
| 0.005 | 10.6 | 34.5 |
| 0.010 | 5.31 | 17.2 |
| 0.020 | 2.62 | 8.62 |
| 0.0254 | 2.07 | 6.83 |
| 0.0381 | 1.38 | 4.55 |

In the nozzles of the present invention, at least part of the bottom surface of the first lip is not parallel to the chill surface; thus, the gap is not constant. As a result, if the meniscus moves, it may encounter a gap for which the permissible pressure range does not include the actual pressure. The meniscus will then be stopped and forced in the opposite direction until it reaches a gap whose range does include the actual pressure. The nozzles of the present invention thus provide a kind of "restoring force" which restricts meniscus excursions. In order to contain the meniscus, and also to minimize the effects of air flow over the molten metal, the leading edge of the first lip is positioned as close to or closer to the chill surface than is any other point on the nozzle.

The nonparallel surface, which provides the restoring force, can take a variety of forms. A surface substantially perpendicular to the chill surface can join two surfaces parallel to the chill surface at different distances from the chill surface. Depending on the magnitude of the gaps and pressures, this perpendicular surface can stop the motion of a moving meniscus, which would continue to an extreme end of a prior art "single-gap" first lip. In a preferred embodiment, the bottom surface of the second lip is substantially parallel to the chill surface and the nonparallel surface of the first lip is a plane inclined to the plane of the chill surface, perferably making an angle of about 5° to 45° with the chill surface. The inclined surface can constitute either a part of the first lip's bottom surface or, preferably, the entire bottom surface. An advantage of the inclined surface is that it provides a continuously varying gap with a corresponding continuous variation in permissible pressure range. The parameters of the first lip's bottom surface (i.e., gap, incline angle, extent of inclined surface, etc.) are chosen to minimize the meniscus excursion range for the pressures to be used.

Figure 2:
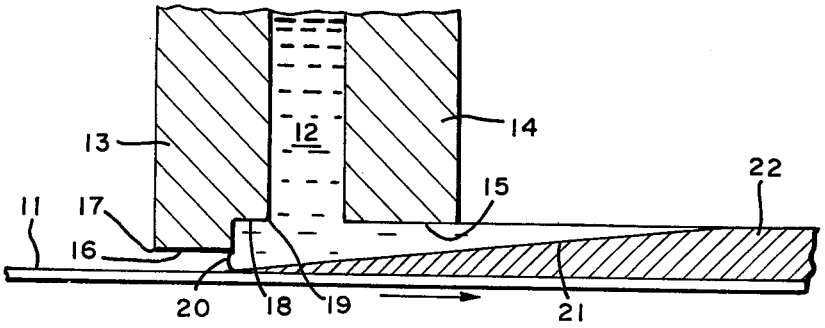
FIG. 2 is a side view in partial cross section illustrating planar flow casting of metal ribbon from a nozzle having a specific configuration relative to the chill surface in accordance with the present invention.

FIG. 2 is a side view in partial cross section illustrating planar flow casting of metal ribbon from a nozzle of one embodiment of the present invention. As shown there, a chill surface 11, here illustrated as a belt, travels in the direction of the arrow in close proximity to a slotted nozzle defined by a first lip 13 and a second lip 14. The bottom surface 15 of second lip 14 is a planar surface substantially parallel to belt 11. The bottom surface of first lip 13 has a first planar surface 16, which includes the leading edge 17 of the first lip and is substantially parallel to belt 11, and a second planar surface 18 which includes the leading edge 19 of the slot, is substantially parallel to belt 11 and is at a greater distance from the belt than is the first planar surface 16. Molten metal 12 is forced under pressure through the nozzle to be brought into contact with the moving chill surface. The molten metal puddle has a rear surface meniscus 20. As the metal is solidified in contact with the surface of the moving chill body, a solidification front, indicated by line 21, is formed. A body of molten metal is maintained above the solidification front, while solidified strip 22 moves downstream and ultimately is separated from the chill surface.

Figure 3:
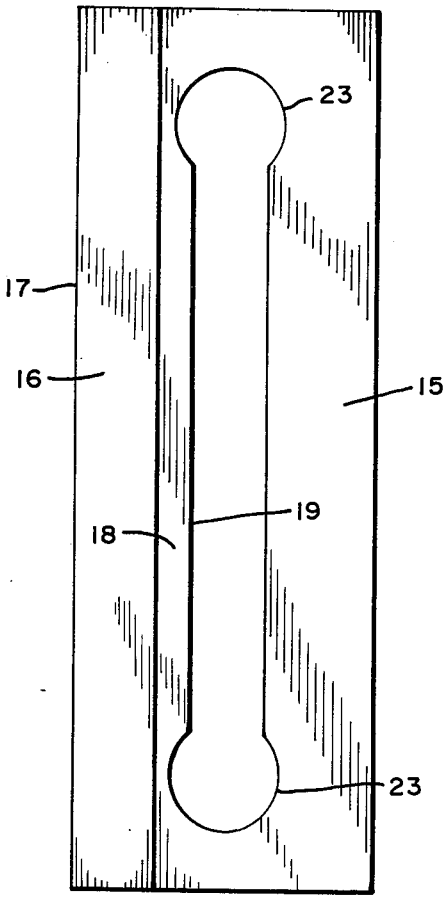
FIG. 3 is a bottom view of the nozzle of FIG. 2.

FIG. 3 is a bottom view of the nozzle of FIG. 2. The slot is shown to have lobed ends 23. When a rectangular slot is employed instead, the amount of molten metal available at the edges of the ribbon may be less than at the center. The lobed slot configuration would then be preferred in order to provide adequate metal to the edges for uniform ribbon cross section.

Figure 4:
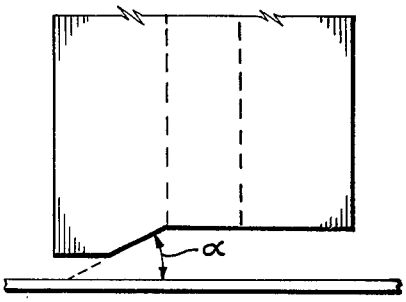
FIGS. 4, 6, 8, 10 and 12 are side views and FIGS. 5, 7, 9, 11 and 13 the corresponding bottom views, respectively, of additional embodiments of nozzles of this invention.
Figure 5:
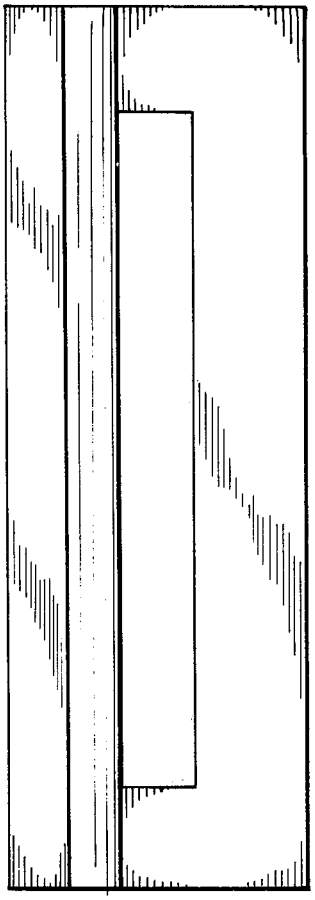
Figure 7:
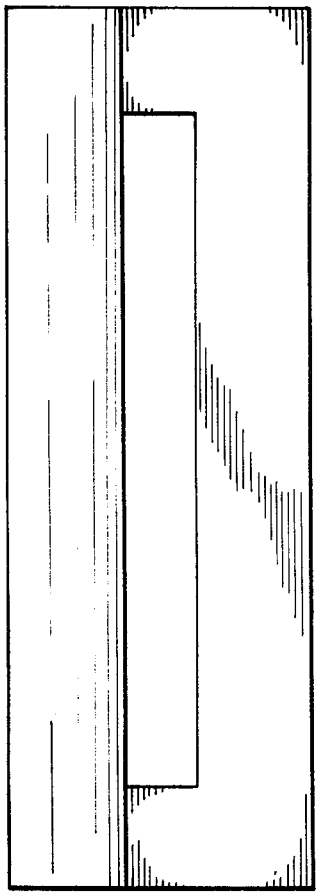

FIGS. 4 and 5 show side and bottom views, respectively, of a nozzle of another embodiment of the present invention wherein the bottom surface of the first lip comprises a substantially planar first surface, which includes the leading edge of the first lip and is substantially parallel to the chill surface, and a second planar surface, which includes the leading edge of the slot and is not parallel to the chill surface. The second planar surface forms an angle $\alpha$ with the plane of the chill surface. Preferably, $\alpha$ is between about 5° and 45°. For simplicity, a rectangular slot cross section is shown in FIG. 5 as well as in FIGS. 7, 9, 11 and 13. However, as discussed earlier, a lobed slot may be used instead.

Figure 6:
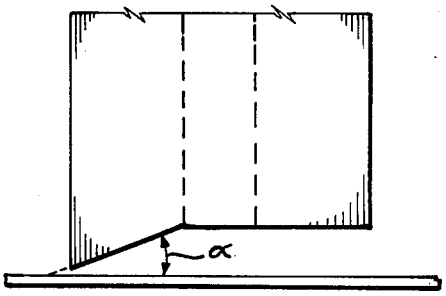

In another embodiment of this invention, the first lip comprises a substantially planar bottom surface, said surface preferably forming an angle $\alpha$ of about 5° to 45° with the plane of the chill surface. An example of this embodiment is shown in a side view in FIG. 6 and a bottom view in FIG. 7. A feature of this embodiment is that the bottom surface of the first lip provides an upper contact for the upstream meniscus over a continuous range of chill surface-lip distances between the leading edge of the lip and the leading edge of the slot.

Figure 8:
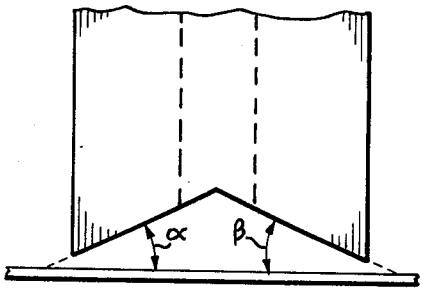
Figure 9:
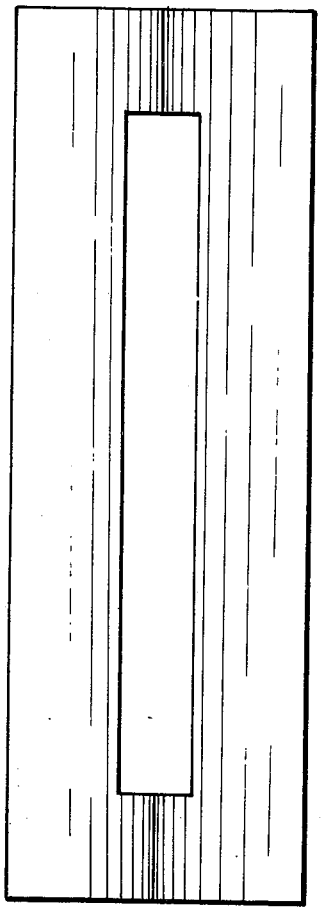

FIGS. 8 and 9 show side and bottom views, respectively, of another embodiment of this invention, wherein the bottom plane of the second lip forms an angle $\beta$ of about 5° to 45° with the plane of the chill surface. Although the nozzle shown in FIGS. 8 and 9 has the first lip forming with the chill surface an angle similar to that formed by the second lip, this is not a requirement, and the first lip may comprise one or more surfaces, which may or may not be parallel to the chill surface. A feature of this embodiment is that the bottom surface of the second lip molds the soft top layer of ribbon, either by physical contact or through an intervening air layer.

Figure 10:
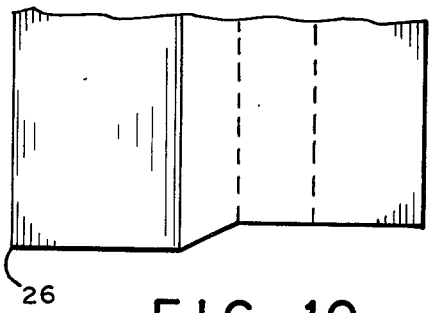
Figure 11:
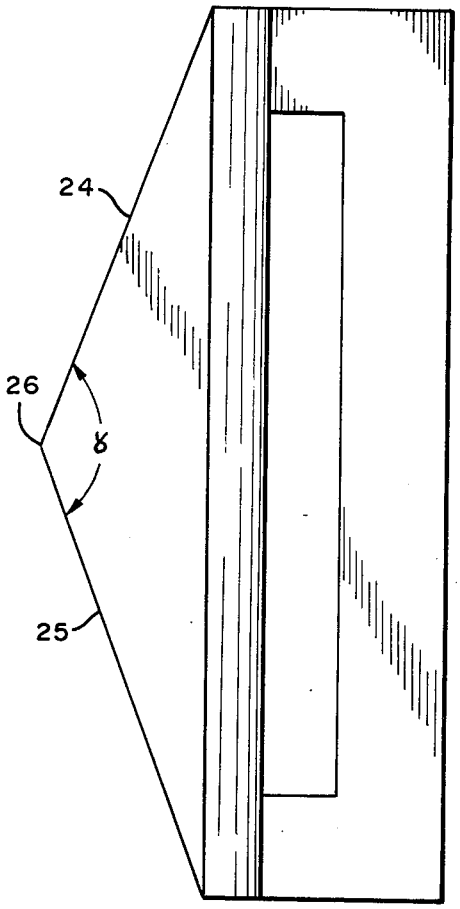

FIGS. 10 and 11 show side and bottom views, respectively, of another embodiment of this invention, wherein the leading edge of the first lip comprises two straight line 24 and 25 of substantially equal length which meet at the front 26 of the leading edge to form an angle $\gamma$, which is preferably between about 90° and 150°. The V-shaped leading face of this nozzle directs air away from the slot and reduces undesirable air entrapment and turbulence.

Figure 12:
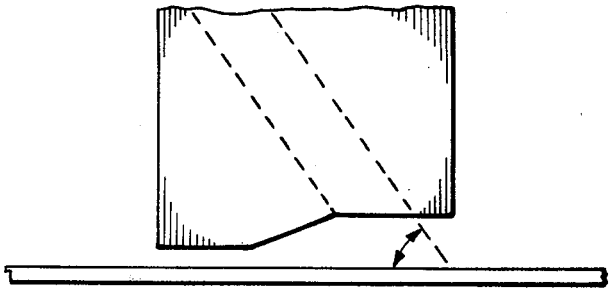
Figure 13:
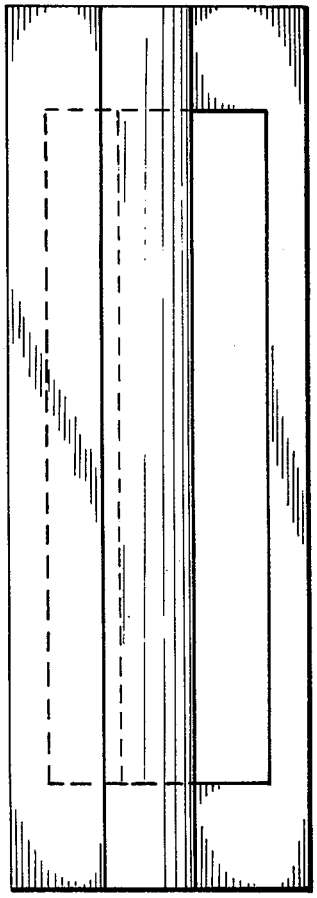

The slot that separates the lips preferably comprises leading and trailing (i.e., upstream and downstream) surfaces which are substantially planar and parallel. These surfaces may be perpendicular to the chill surface or, alternatively, may form an angle $\delta$ of about 30° to 90° with the plane of the chill surface, the slot exit pointing in the direction of movement of the chill surface. An example of this embodiment is shown in FIGS. 12 and 13. By providing to the molten metal a component of velocity in the direction of motion of the chill surface as it leaves the slot, this embodiment reduces the tendency of air turbulence to produce waviness and other undesirable patterns in the upper surface of the molten metal puddle.

The apparatus of the present invention is suitable for forming polycrystalline ribbon of aluminium, tin, copper, iron, steel, stainless steel and the like.

Metal alloys that, upon rapid cooling from the melt, form solid amorphous structures are preferred. These are well known to those skilled in the art. Examples of such alloys are disclosed in U.S. Pat. Nos. 3,427,154; 3,981,722 and others.

We claim:

1. An apparatus for planar flow casting of metal ribbon comprising a movable chill surface, a reservoir for holding molten metal and a nozzle in communication at its top with the reservoir and having at its bottom two lips adjacent to the chill surface, a first lip and a second lip numbered in the direction of movement of the chill surface, wherein the lips are separated by and define a slot for depositing molten metal on the chill surface, the leading and trailing edges of the slot are substantially parallel to each other and are generally perpendicular to the direction of movement of the chill surface, the second lip has a substantially planar bottom surface, the first lip has a bottom surface at least part of which is upstream from the leading edge of the slot and not parallel to the bottom surface of the second lip, the leading edge of the first lip is separated from the chill surface by at least about 0.02 mm and is as close or closer to the chill surface than is any other point on the nozzle and no point on the bottom surface of the nozzle is more than about 1 mm from the chill surface.

2. The apparatus of claim 1 wherein the bottom surface of the second lip is substantially parallel to the adjacent chill surface.

3. The apparatus of claim 1 wherein the bottom surface of the first lip comprises:

a substantially planar first surface which includes the leading edge of the first lip and is substantially parallel to the chill surface and a second planar surface which includes the leading edge of the slot, is substantially parallel to the chill surface and is at a greater distance from the chill surface than is the first planar surface.

4. The apparatus of claim 1 wherein the bottom surface of the first lip is substantially planar.

5. The apparatus of claim 4 wherein the angle between the bottom plane of the first lip and the plane of the chill surface is about 5° to 45°.

6. The apparatus of claim 1 wherein the angle between the bottom surface of the second lip and the plane of the chill surface is about 5° to 45°.

7. The apparatus of claim 1 wherein the leading edge of the first lip comprises two straight lines of substantially equal length which meet at the front of the leading edge.

8. The apparatus of claim 1 wherein the leading and trailing surfaces of the slot separating the lips comprise two substantially parallel planes which form an angle of about 30° to 90° with the plane of the chill surface, the slot exit pointing in the direction of movement of the chill surface.

* * * * *